US007926235B2

(12) United States Patent
Shaw et al.

(10) Patent No.: US 7,926,235 B2
(45) Date of Patent: Apr. 19, 2011

(54) MONOLITHIC CONCRETE WALL EXPANSION JOINT SYSTEM

(75) Inventors: Lee A. Shaw, Newport Beach, CA (US); Ronald D. Shaw, Corona Del Mar, CA (US)

(73) Assignee: Shaw & Sons, Inc., Costa Mesa, CA (US)

( * ) Notice: Subject to any disclaimer, the term of this patent is extended or adjusted under 35 U.S.C. 154(b) by 0 days.

(21) Appl. No.: 12/628,906

(22) Filed: Dec. 1, 2009

(65) Prior Publication Data

US 2010/0071290 A1 Mar. 25, 2010

Related U.S. Application Data

(63) Continuation of application No. 11/635,439, filed on Dec. 7, 2006, now abandoned.

(51) Int. Cl.
*E04B 1/682* (2006.01)

(52) U.S. Cl. ..... 52/396.02; 52/699

(58) Field of Classification Search ..... 52/393, 52/395, 396.02, 396.04, 396.05, 573.1, 742.14, 52/745.09
See application file for complete search history.

(56) References Cited

U.S. PATENT DOCUMENTS

| | | | | | |
|---|---|---|---|---|---|
| 1,690,295 | A | | 11/1928 | Heltzel | |
| 2,299,670 | A | | 10/1942 | Westcott | |
| 2,305,979 | A | * | 12/1942 | Mitchell | 404/59 |
| 2,365,550 | A | * | 12/1944 | Heltzel | 404/59 |
| 2,508,443 | A | | 5/1950 | Carter | |
| 2,575,247 | A | | 11/1951 | Carter | |
| 2,834,266 | A | | 5/1958 | Brickman | |
| 2,858,749 | A | | 11/1958 | Crone | |
| 3,417,528 | A | * | 12/1968 | Hallock | 52/367 |
| 4,012,024 | A | * | 3/1977 | Courtois | 249/9 |
| 4,339,106 | A | | 7/1982 | Navarro | |
| 4,393,568 | A | | 7/1983 | Navarro | |
| 4,522,531 | A | * | 6/1985 | Thomsen et al. | 404/2 |
| 4,723,752 | A | | 2/1988 | Thomas | |
| 4,804,292 | A | * | 2/1989 | DeLuca | 404/69 |
| 4,834,576 | A | * | 5/1989 | Argento | 404/62 |
| 5,044,835 | A | * | 9/1991 | Fukushima et al. | 405/287 |
| 5,335,466 | A | * | 8/1994 | Langohr | 52/396.04 |
| 5,384,996 | A | * | 1/1995 | Nicholas | 52/468 |
| 5,487,249 | A | * | 1/1996 | Shaw et al. | 52/396.02 |
| 5,522,579 | A | | 6/1996 | Rock | |

(Continued)

OTHER PUBLICATIONS

White Cap Industries, Inc., "Simpson SBV Shelf Bracket", p. 607.

(Continued)

*Primary Examiner* — Brian E Glessner
*Assistant Examiner* — Benjamin Pevarski
(74) *Attorney, Agent, or Firm* — Stetina Brunda Garred & Brucker

(57) ABSTRACT

An expansion joint system for a wall is provided herein wherein a first concrete wall component is substantially separated from a second concrete wall component via a rigid plate such that contraction of the first concrete wall component does not create significant stresses in the first or second concrete wall component so as to create cracks in the first or second concrete wall component. Moreover, a compressible material may be disposed between the rigid plate and/or the first and/or second concrete wall component such that expansion of the first concrete wall component compresses the compressible material instead of imposing significant stresses on the first or second concrete wall component so as to be likely to form cracks in the first or second concrete wall component.

11 Claims, 3 Drawing Sheets

U.S. PATENT DOCUMENTS

| | | | | |
|---|---|---|---|---|
| 5,584,152 | A | 12/1996 | Baerveldt | |
| 5,817,247 | A | 10/1998 | Colatruglio | |
| 6,026,622 | A * | 2/2000 | Schmid | 52/396.02 |
| 6,128,874 | A * | 10/2000 | Olson et al. | 52/232 |
| 6,230,451 | B1 | 5/2001 | Stoller | |
| 6,293,066 | B1 * | 9/2001 | Lohrey | 52/396.08 |
| 6,540,201 | B1 | 4/2003 | Gagnon et al. | |
| 7,097,147 | B2 | 8/2006 | Shaw et al. | |
| 2002/0062603 | A1 | 5/2002 | Shaw et al. | |
| 2005/0066600 | A1 * | 3/2005 | Moulton et al. | 52/393 |

OTHER PUBLICATIONS

Aztec, "Revolutionary New Nail-Less Tilt Panel Forming System", 1 pg.

White Cap Industries, Inc., "Panel-Trak Forming System", 1 pg.

Simpson Strongtie, "SBV/CF-R Shelf Brackets/Concrete Form Angles", Mar. 24, 2004, 2 pgs.

Chameleon Cast Wall Systems, LLC, "Build Beautiful Tilt-Up", 1 pg.

* cited by examiner

MONOLITHIC CONCRETE WALL EXPANSION JOINT SYSTEM

CROSS-REFERENCE TO RELATED APPLICATIONS

The present application is a continuation of U.S. patent application Ser. No. 11/635,439 entitled MONOLITHIC CONCRETE WALL EXPANSION JOINT SYSTEM filed Dec. 7, 2006.

STATEMENT RE: FEDERALLY SPONSORED RESEARCH/DEVELOPMENT

Not Applicable

BACKGROUND

The present invention relates to a concrete wall structure.

One problem in building or constructing large concrete walls is cracks that form in the concrete wall due to the expansion or contraction of the concrete wall. The concrete wall expands and contracts due to changes in humidity and temperature. Although in small concrete walls, the amount of expansion and contraction of the concrete wall may be structurally negligible, in large concrete walls, the aggregate amount of expansion or contraction may be structurally significant to impose significant stresses on the concrete wall to crack the same.

To mitigate against the likelihood of cracks in a large concrete wall, large concrete walls are typically constructed in smaller segments. By way of example and not limitation, a long concrete wall (see FIG. 1) may be formed via a A-B forming process. In particular, a wall form is erected at the desired location of the concrete wall. Instead of filling the entire wall form with uncured concrete, the wall form is divided into a plurality of smaller segments. Every other segment (i.e., "A" segment) is filled with uncured concrete. The concrete is then allowed to set. Thereafter, the empty segments (i.e., "B" segments) of the wall form are filled with uncured concrete.

The A-B pouring system mitigates against crack formation but has many deficiencies. The A-B pouring system requires the contractor to pour uncured concrete twice and allow sufficient time for the uncured concrete to set twice. The contractor must be present on the job site on two different days. The additional time may delay construction of the building or project. Also, the additional time requires additional labor costs increasing the price of the project and also reducing the profit margins of the contractor. Moreover, in architectural concrete structures, the first batch of uncured concrete may be different from the second batch of uncured concrete leading to color variations in adjacent segments of the wall especially in colored concrete.

Accordingly, there is a need in the art for an improved method and device for building large concrete walls.

BRIEF SUMMARY

The wall expansion joint system discussed herein addresses the needs discussed above, discussed below and those that are known in the art.

The wall expansion joint system may be disposed between a first concrete wall component and a second concrete wall component. More particularly, the wall expansion joint system may comprise a rigid plate defining a left edge, right edge and an upper edge. The left, right and upper edges of the rigid plate may be lower or hidden within the left surfaces, right surfaces and upper surfaces of the first and second concrete wall components. In a concrete wall, depressions may be formed between the first and second concrete wall components which extend from the upper surfaces, left surfaces and right surfaces thereof to the left edge, right edge and upper edge of the rigid plate. The first concrete wall component is not a unitary structure with the second concrete wall component. They are separated by the rigid plate. Due to humidity changes and temperature changes, the first and second concrete wall components may contract. In this situation, the first concrete wall component may contract away from the second concrete wall component. Nonetheless, contraction of the first concrete wall component does not create significant stresses within the first or second concrete wall component so as to form cracks therein. Conversely, contraction of the second concrete wall component does not create significant stresses in the first or second concrete wall component so as to form cracks therein. Such contraction does not create significant stresses within either of the first or second concrete wall components that would create a crack within the first or second concrete wall component.

Moreover, the wall expansion joint system may further comprise an optional compressible material (e.g., felt, polyfoam, rubber, etc.). The compressible material may be disposed between the first and/or second concrete wall components and adjacent to the front surface and/or rear surface of the rigid plate. The compressible material permits the first and second concrete wall components to expand due to temperature changes and humidity changes without imposing a sufficient amount of stress in the first and/or second concrete wall components so as to promote cracks therein. By way of example and not limitation, expansion of the first concrete wall component compresses the compressible material instead of imposing significant stresses on the first or second concrete wall component. Likewise, expansion of the second concrete wall component compresses the compressible material and does not create significant stresses in the first or second concrete wall component so as to create cracks in the first or second concrete wall component. The rigid plate and the compressible material permit contraction and expansion of the first and second concrete wall components in a longitudinal direction.

Optionally, the first and second concrete wall components may be fixed to each other in a transverse (i.e., horizontal) direction and a vertical direction. In particular, the first concrete wall component may have a sheath disposed therein. The sheath may have a cavity which is aligned to a longitudinal direction of the first and second concrete wall components. The sheath may be attached to the rigid plate and disposed within the first concrete wall component. The sheath cavity provides a longitudinal pathway for a dowel fixedly disposed within the second concrete wall component. When the first and second concrete wall components expand and contract, the dowel slides into and out of the sheath. However, the speed dowel prevents transverse motion and vertical motion between the first and second concrete wall components.

In an aspect of the expansion joint system, the depression formed in the first and second concrete wall components may extend from the left surfaces, upper surfaces and right surfaces of the first and second concrete wall components to at least the left edge, upper edge and right edge of the rigid plate with the aid of a molding. The molding may have a cross sectional tapered configuration with a slot formed in a narrow side of the molding. The slot may be sized and configured to receive the edge of the rigid plate. To construct the first and second concrete wall components, moldings may be attached to the left edge, upper edge and the right edge of the rigid plate before uncured concrete is poured into a wall form. The rigid plate and molding(s) may be appropriately arranged within the wall form. Uncured concrete may then be poured within the wall form. The top surface of the upper molding may define the upper surfaces of the first and second concrete wall components.

The expansion joint system discussed herein mitigates against crack formation in concrete walls. The expansion joint system discussed herein permits the contractor to pour uncured concrete in the entire wall form once. The A-B pouring system is not needed. Accordingly, color variations between segments of the wall are minimized because the same concrete mix is used to form the wall during a single pour. In contrast, in prior art concrete walls, the same concrete mix is not used to form the entire concrete wall. Rather, every other segment of the wall uses the same concrete mix. Accordingly, in the prior art, adjacent segments of the wall use a different concrete mix, and thus, color variations will arise between adjacent segments of the wall. Beneficially, the expansion joint system of the present invention reduces the amount of labor and time to construct and build a concrete wall because the contractor can eliminate the step of pouring uncured concrete the second time.

The expansion joint system discussed herein permits the contractor to form the large wall by pouring the uncured concrete once thereby saving time. Moreover, the expansion joint system discussed herein separates the large concrete wall into smaller segments such that although expansion and contraction of the concrete wall as an aggregate may be substantial, the effects of such aggregate expansion and contraction are structurally insignificant as to each segment individually.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
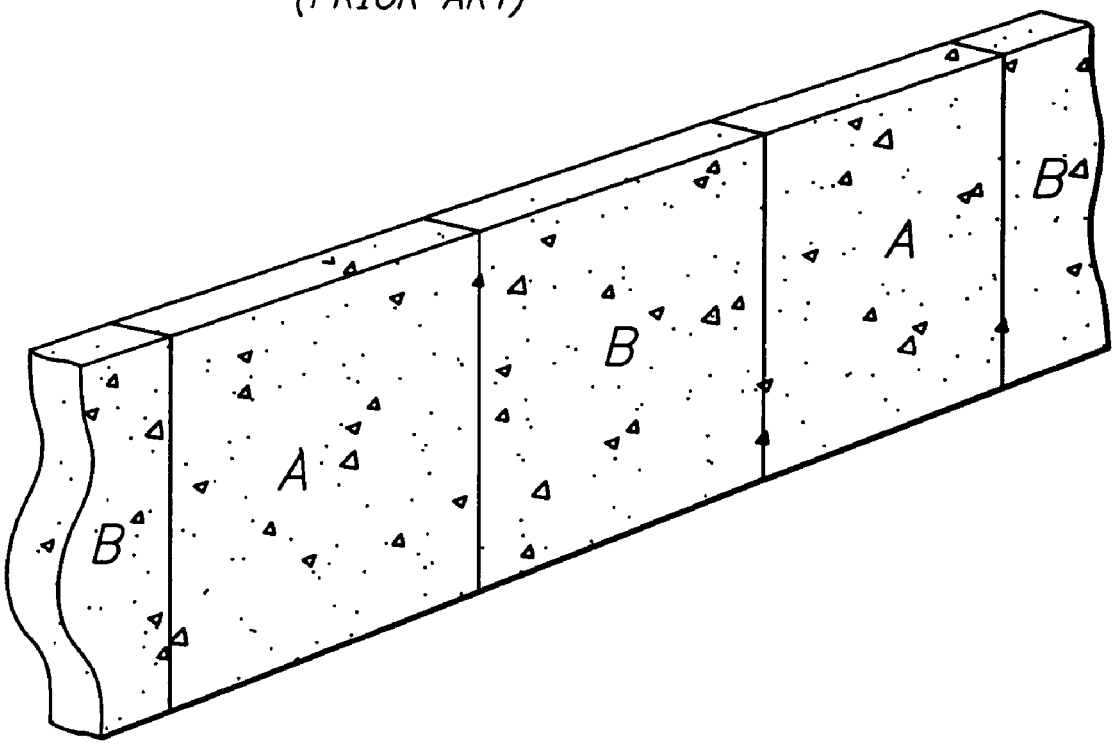
FIG. 1 (PRIOR ART)
FIG. 1 is a prior art wall formed via an A-B pouring process wherein every other wall segment "A" was formed then the intervening wall segments "B" were subsequently formed.
Figure 2:
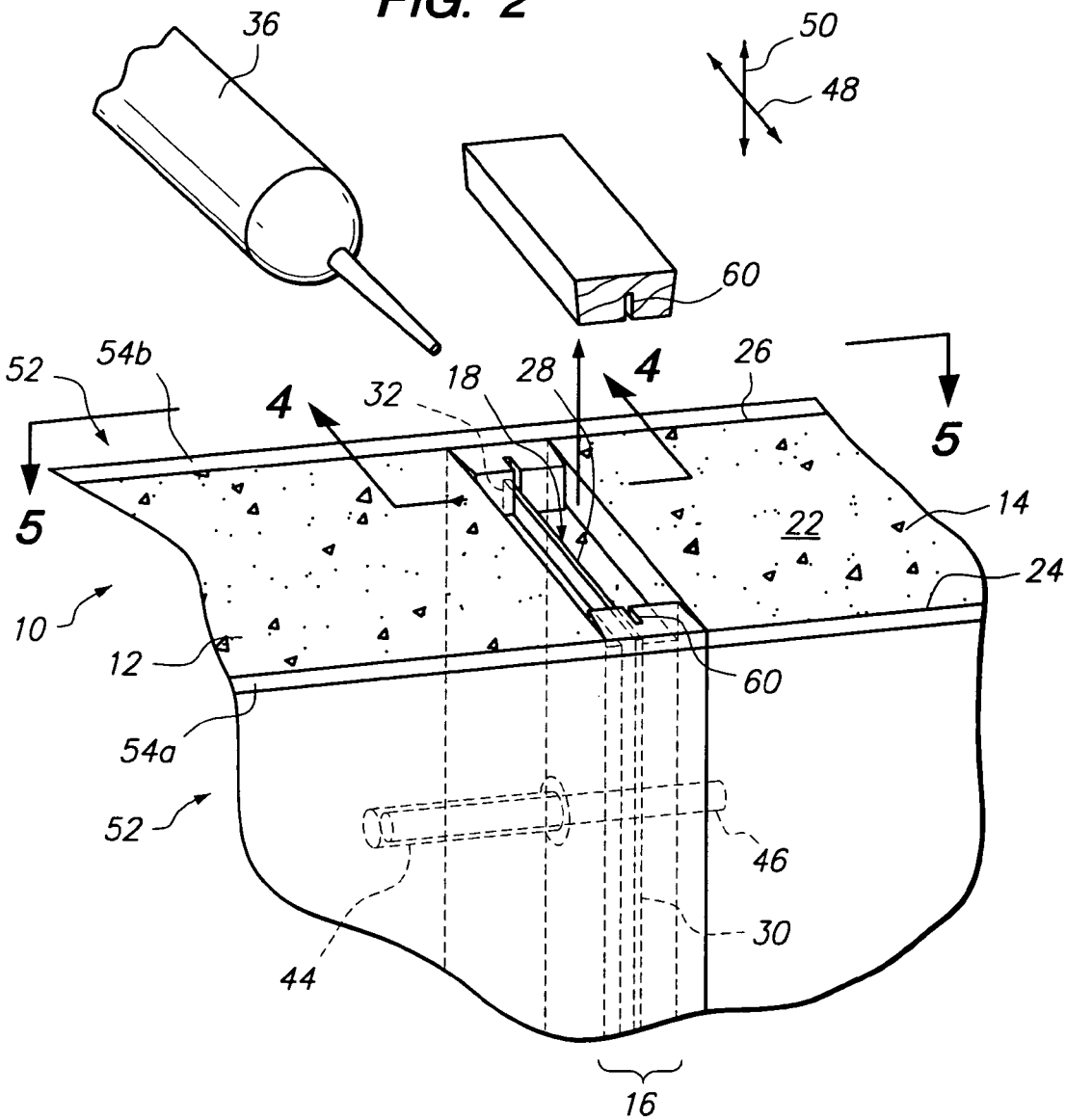
FIG. 2 is a top perspective view of a wall formed with a joint expansion system disposed between a first concrete wall component and a second concrete wall component.

Referring now to FIG. 2, a concrete wall 10 is shown having a first concrete wall component 12 and a second concrete wall component 14 joined via an expansion joint system 16. The expansion joint system 16 allows the first concrete wall component 12 and the second concrete wall component 14 of the wall 10 to expand and contract due to temperature fluctuations and humidity fluctuations without stressing the first or second concrete wall component 12, 14 so as to cause cracks therein. Accordingly, the expansion joint system 16 controls cracks in the first and second concrete wall components 12, 14 to maintain the aesthetic appeal of the wall 10.

Figure 3:
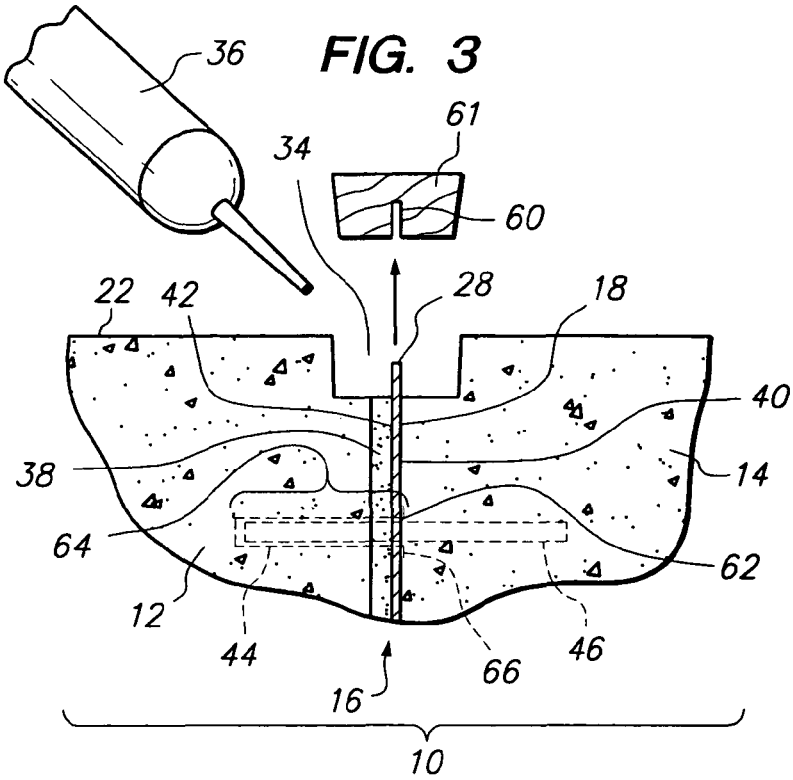
FIG. 3 is a side elevational cross sectional view of FIG. 2.
Figure 4:
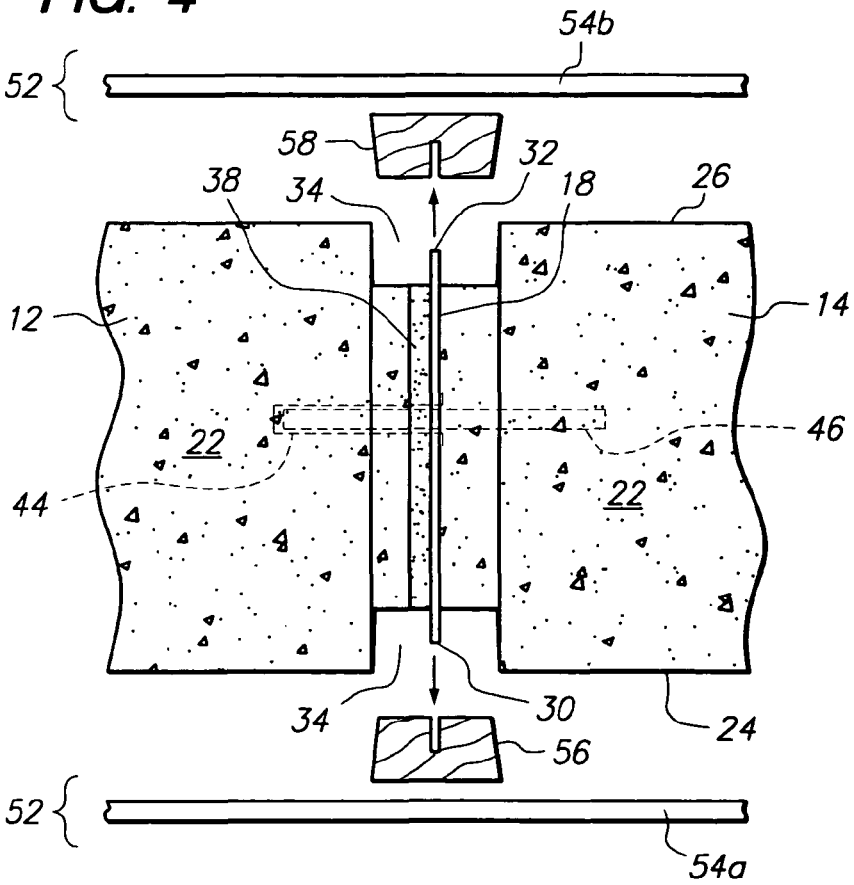
FIG. 4 is a top view of FIG. 2.

The expansion joint system 16 may comprise a rigid plate 18 disposed between the first and second concrete wall components 12, 14. The rigid plate 18 may be smaller than a cross-sectional area of the first and second concrete wall components 12, 14. In particular, each of the first and second concrete wall components 12, 14 may define an upper surface 22 (see FIGS. 2 and 3), left surface 24, and right surface 26. The rigid plate 18 may define an upper edge 28, left edge 30 and a right edge 32. The upper edge 28, left edge 30 and right edge 32 of the rigid plate 18 may not extend beyond the upper surfaces 22, left surfaces 24 and right surfaces 26 of the first and second concrete wall components 12, 14, as shown in FIGS. 2-4. In other words, the rigid plate 18 may be disposed within the planes defined by the left surfaces 24, upper surfaces 22 and right surfaces 26 of the first and second concrete wall components 12, 14. The rigid plate 18 separates the first concrete wall component 12 from the second concrete wall component 14. A depression 34 may be formed about the concrete wall 10 around the periphery of the rigid plate 18. The rigid plate 18 may extend outward into the depression 34 but still yet remain within the confines of the planes defined by the left surfaces 24, upper surfaces 22 and right surfaces 26 of the first and second concrete wall components 12, 14. To make the wall 10 more aesthetically pleasing, the depression 34 may be caulked 36 up to about the left surfaces 24, upper surfaces 22 and the right surfaces 26 of the first and second concrete wall component 12, 14 so as to cover and hide the rigid plate 18.

The expansion joint system 16 may also comprise an optional compressible material 38 disposed adjacent front and/or rear surfaces 40, 42 (see FIG. 3) of the rigid plate 18. In FIGS. 2-4, the compressible material 38 is shown adjacent the rear surface 42 of the rigid plate 18. The compressible material 38 may be felt, polyfoam, rubber or the like. The compressible material 38 is for the purpose of allowing the first and second concrete wall components 12, 14 to expand due to temperature fluctuations and humidity fluctuations without creating stress concentrations in the first and second wall components 12, 14 so as to cause cracks therein.

The expansion joint system 16 may also have a sheath 44 disposed within the first concrete wall component 12 and a dowel 46 fixedly disposed within the second concrete wall component 14 but slidingly receivable into the sheath 44. The sheath 44 and dowel 46 permits the first and second concrete wall components 12, 14 to expand and contract but limits the vertical and horizontal (i.e., transverse) movements 50, 48 (see FIG. 2) therebetween such that the left surfaces 24, upper surfaces 22 and right surfaces 26 of the first and second concrete wall components 12, 14 appear to be aligned to each other despite any expansion or contraction of the first and second concrete wall components 12, 14.

To form the wall 10 having a first concrete wall component 12, second concrete wall component 14 and a expansion joint system 16 therebetween 12, 14, a wall form 52 may be fabricated. The wall form 52 may comprise left and right plywoods 54*a, b*. Outer surfaces of the left and right plywoods 54*a, b* may be braced such that the left and right plywoods 54*a, b* do not bend or bow when uncured concrete is poured into the wall form 52. A left molding 56 and a right molding 58 may be attached to the left plywood 54*a* and the right plywood 54*b*. The left and right moldings 56, 58 may be attached to the left and right plywoods 54*a, b* via a screw or nail. The left and right moldings 56, 58 may each have a slot 60 which is sized and configured to receive the left and right edges 30, 32 of the rigid plate 18. After the left and right moldings 56, 58 are attached to the left and right plywoods 54*a, b*, the rigid plate 18 may be slid into the slots 60 of the left and right moldings 56, 58. Alternatively, the left and right moldings 56, 58 may be disposed on the left and right edges 30, 32 of the rigid plate 18 by inserting the left and right edges 30, 32 of the rigid plate 18 into the slots 60 formed in the left and right moldings 56, 58. With the left and right moldings 56, 58 attached or disposed on the rigid plate 18, the rigid plate 18 and left and right moldings 56, 58 may be disposed in the wall form 52. Thereafter, an attachment device (e.g., screw, nail, etc.) may be used to attach the left molding 56 to the left plywood 54*a* and the right molding 58 to the right plywood 54*b*. An upper molding 61 may also have a tapered cross-sectional configuration and slot 60 formed at the narrow end of the upper molding 61. The upper molding 61 may be disposed above the rigid plate 18 such that the slot 60 thereof receives the upper edge 28 of the rigid plate 18. Each of the left and right moldings 56, 58 and the upper molding 61 may have a tapered configuration such that after the poured concrete is hardened, the molding 56, 58, 61 may be removed from the concrete wall structure. The moldings 56, 58, 61 may be fabricated from rigid plastic, wood, rubber, or the like.

As shown in FIG. 2, the left and right plywoods 54*a, b* along with the rigid plate 18 separate a first cavity from a second cavity. Uncured concrete may be poured into the first cavity and the second cavity at one time. The concrete sets to form the first and second concrete wall components 12, 14. When the concrete is poured within the first and second cavities, the concrete is filled up to the upper surface of the upper molding 61.

Before the first and second cavities are filled with concrete, the sheath 44 and dowel 46 may be attached to the rigid plate 18 and positioned within the first and second cavities. In particular, an aperture 62 (see FIG. 3) may be formed in the rigid plate 18. The aperture 62 may be sized and configured to receive an outer periphery of the sheath 44. The sheath 44 may have an elongate portion 64 and a lip 66 (see FIG. 3). The sheath 44 may be inserted through the aperture 62 of the rigid plate 18 until the lip 66 contacts the rigid plate 18. The lip 66 is then attached to the rigid plate 18 via methods known in the art (e.g., glue, adhesive, etc.). The elongate portion 64 of the sheath 44 may be disposed in the first cavity. The sheath 44 may have a hollow cavity which is sized and configured to slidingly receive the dowel 46. After the sheath 44 is attached through the rigid plate 18, the dowel 46 may be inserted through the entrance of the sheath cavity. At this point, the sheath 44 projects into the first cavity and a portion of the dowel 46 extends into the second cavity.

Rebar may be also disposed and aligned within the first and second cavities to provide strength to the first and second concrete wall components 12, 14. The rebar may also be shaped so as to support the sheath 44 and dowel 46 within the first and second cavities.

After the wall form 52 and the expansion joint system 16 is set up, uncured concrete may be poured into the first cavity and the second cavity at the same time. The concrete is now allowed to cure. After the concrete is cured, as shown in FIG. 4, the left and right plywoods 54*a, b* are removed from the wall 10. Additionally, the left and right moldings 56, 58 are also removed and forms left and right grooves or depressions 34 in the wall 10 between the first and second concrete wall components 12, 14. Additionally, the upper molding 61 is removed (see FIG. 3) from the wall 10 forming an upper groove or upper depression 34.

Beneficially, the first concrete wall component 12 may be separated from the second concrete wall component 14 with a rigid plate 18 and/or a compressible material 38. The amount of stress in the first or second concrete wall component 12, 14 due to contraction and expansion of the first or second concrete wall component 12, 14 is eliminated or reduced thereby reducing the possibility of crack formation in first or second concrete wall component 12, 14.

In an aspect of the expansion joint system 16 discussed herein, the depression 34 does not have to extend from the upper surfaces 22 of the first and second concrete wall component 12, 14 to the upper edge 28 of the rigid plate 18. Similarly, the depression 34 does not have to extend from the left and right surfaces 24, 26 of the first and second concrete wall components 12, 14 to the left and right edges 30, 32 of the rigid plate 18. Rather, a small amount of concrete may cover the upper edge 28, left edge 30, and/or right edge 32 to hide an upper edge 28, left edge 30 and/or right edge 32 of the rigid plate 18.

By way of example and not limitation, a depression 34 may be formed between the upper surfaces 22 of the first and second concrete wall components 12, 14. The depression 34 may extend from the upper surfaces 22 of the first and second concrete wall components 12, 14 into the first and second concrete wall components 12, 14 but shy of the upper edge 28 of the rigid plate 18. A small amount of concrete may cover the upper edge 28 of the rigid plate 18. The depression 34 may be caulked 36 so as to fill in the depression 34. In the event that the first and second concrete wall components 12, 14 expand and/or contract, the concrete above the rigid plate 18 being the weakest joint will crack. The caulking 36 will hide the crack and the rigid plate 18, if the rigid plate 18 becomes exposed. The upper molding 61 may be supported above the upper edge 28 of the rigid plate 18 by attaching the distal ends of the upper molding 61 to the left and right moldings 56, 58.

The depressions 34 may be formed in the left and right surfaces 24, 26 of the first and second concrete wall components 12, 14 but shy of the left and right edges 30, 32 of the rigid plate 18 by attaching the left and right moldings 56, 58 to the left and right plywoods 54*a, b* of the wall form 52. The rigid plate 18 may be held in position by attaching the rigid plate 18 to the ground or attaching the rigid plate 18 to rebar within the first or second concrete wall component 12, 14. The rigid plate 18 does not contact the left and right moldings 56, 58. The upper molding 61 may be disposed above the upper edge 28 of the rigid plate 18 but not in contact therewith 28. To this end, the distal ends of the upper molding 61 may be attached to the left and right moldings 56, 58, as discussed above.

In an aspect of the expansion joint system 16, the step of caulking or the caulking 36 is an optional step or element. It is not required. The caulking 36 is only used for aesthetic purposes to hide the crack formed adjacent the edges of the rigid plate 18 or the rigid plate 18 itself. Moreover, instead of caulking, other types of materials 38 may be used to fill in the depression 34 such as plastic, rubber, cloth, etc. so as to hide the upper edge 28, left edge 30 and/or the right edge 32 of the rigid plate 18.

In an aspect of the expansion joint system 16, the rigid plate 18 may be replaced with the compressible material 38. The rigid plate 18 is not used as part of the expansion joint system. The compressible material 38 may separate the first concrete wall component 12 and the second concrete wall component 14 such that contraction of the first or second concrete wall component 12, 14 does not create stresses within the first or second concrete wall component 12, 14. Also, as discussed above, the compressible material 38 allows the first and/or second concrete wall component 12, 14 to expand without creating significant stresses within the first or second concrete wall component 12, 14 so as to form cracks therein. The compressible material 38 compresses to allow for the expansion of the first or second concrete wall components 12, 14. The compressible material 38 may be supported by sizing the slots 60 of the left, right and upper moldings 56, 58, 61 such that compressible material 38 is frictionally held within the slots 60 of the left, right and upper moldings 56, 58, 61. If the depressions 34 are formed just shy of the edges of the compressible material 38 as explained above in relation to the rigid plate 18, a lower edge of the compressible material 38 may be attached (e.g., screw, insertion, etc.) to the ground. The concrete may be poured into the wall form. The compressible material 38 may be vertically supported by hand until the concrete is completely poured into the wall form 52.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A concrete wall structure joint system for mitigating against crack formation-in a wall, the system comprising:

a first concrete wall component defining a first upper surface, a first left surface and a first right surface;

a second concrete wall component defining a second upper surface, a second left surface and a second right surface; and a joint for mitigating against crack formation in the first and second concrete wall components, the joint comprising:

a rigid plate disposed between the first and second concrete wall components, an exposed upper edge portion of the rigid plate being lower than the first and second upper surfaces of the first and second concrete wall components, exposed left and right edge portions of the rigid plate being recessed interiorly with respect to the first and second left and right surfaces of the first and second concrete wall components;

an upper depression formed in the upper surfaces of the first and second concrete wall components with the exposed upper edge portion disposed within the upper depression;

a left depression formed in the first and second left surfaces of the first and second concrete wall components with the exposed left edge portion disposed within the left depression; and a right depression formed in the first and second right surfaces of the first and second concrete wall components with the exposed right edge portion disposed within the right depression.

2. The system of claim 1 wherein rigid plate has an aperture, and the joint further comprises:

a sheath disposed within the first concrete wall component, the sheath having an opening and a cavity, the opening aligned to the aperture of the rigid plate;

an elongate member fixedly engaged to the first concrete wall component, slideable through the aperture of the rigid plate and the opening of the sheath, and slideable within the cavity of the sheath for permitting longitudinal movement between the first and second concrete wall components but limiting horizontal and vertical movements of the first concrete wall component with respect to the second concrete wall component.

3. The system of claim 1 further comprising a molding disposed above the upper edge portion of the rigid plate to form the depression.

4. The system of claim 3 wherein an upper surface of the molding is level with the upper surfaces of the first and second concrete wall components.

5. The system of claim 3 wherein the molding is attached to the upper edge portion of the rigid plate.

6. The system of claim 3 wherein the molding is removeably disposable from the system.

7. The system of claim 1 further comprising a compressible material disposed between the rigid plate and the first concrete wall component.

8. The system of claim 1 wherein the first and second concrete wall components collectively form the wall.

9. The system of claim 2 wherein the elongate member is a dowel.

10. The system of claim 1 further comprising a filler material disposed within the upper, left and right depressions for hiding the upper, left and right edge portions of the rigid plate.

11. The system of claim 10 wherein the filler material is caulking.

* * * * *